United States Patent [19]

Boecker et al.

[11] Patent Number: 4,635,556

[45] Date of Patent: Jan. 13, 1987

[54] PENETRATOR SHELL WITH STACKED CORE ELEMENTS

[75] Inventors: Juergen Boecker, Oberhausen; Hans W. Luther, Kaarst; Peter Wallow, Duesseldorf; Horst Fritsch, Meerbuch, all of Fed. Rep. of Germany

[73] Assignee: Rheinmetall GmbH, Duesseldorf, Fed. Rep. of Germany

[21] Appl. No.: 476,408

[22] Filed: Mar. 17, 1983

[30] Foreign Application Priority Data

Mar. 17, 1982 [DE] Fed. Rep. of Germany ..... 3209593

[51] Int. Cl.[4] ..... F42B 11/06

[52] U.S. Cl. ..... 102/518

[58] Field of Search ..... 102/514–519, 102/501, 506, 507, 430

[56] References Cited

U.S. PATENT DOCUMENTS

| | | | |
|---|---|---|---|
| 1,017,928 | 2/1912 | Tocik | 102/506 |
| 1,301,859 | 4/1919 | McKenna et al. | 102/519 |
| 2,564,870 | 8/1951 | Weiss | 102/518 |
| 3,028,808 | 4/1962 | Porter et al. | 102/517 X |
| 3,370,535 | 2/1968 | Permutter | 102/518 |
| 3,780,658 | 12/1973 | de Longueville et al. | 102/518 |
| 3,890,902 | 6/1975 | Travor et al. | 102/518 |
| 4,108,072 | 8/1978 | Trinks et al. | 102/515 |
| 4,353,302 | 10/1982 | Strandli et al. | 102/518 |

FOREIGN PATENT DOCUMENTS

| | | | |
|---|---|---|---|
| 2323798 | 11/1974 | Fed. Rep. of Germany | 102/517 |

*Primary Examiner*—Harold J. Tudor

[57] ABSTRACT

A penetrator shell has similar front, intermediate, and rear core elements each having an at least partially forwardly convex front face and an at least partially complementarily rearwardly concave rear face and lying in a stack extending along an axis with the front faces of the intermediate and rear elements engaging in the rear faces of the respective front and intermediate elements. A high-density main penetrator body engages against and extends axially rearward away from the rear face of the rear body. A high-density casing sleeve engaged snugly around the core elements has a front end generally at the front element and a rear end secured to the main penetrator body. An aerodynamic tip is secured to and extends axially forward from the front end of the sleeve. This tip bears axially rearward on the front core element and presses same and the other elements axially rearward against one another and the main penetrator body.

2 Claims, 2 Drawing Figures

PENETRATOR SHELL WITH STACKED CORE ELEMENTS

FIELD OF THE INVENTION

The present invention relates to a penetrator shell. More particularly this invention concerns such a shell having a plurality of core elements carried on a main penetrator body.

BACKGROUND OF THE INVENTION

An undercaliber penetrator shell is known from German patent document 2,743,732 which has similar front, intermediate, and rear core elements each having a front face and a rear face and lying in a stack extending along an axis with the front faces of the intermediate and rear elements engaging the rear faces of the respective front and intermediate elements. A high-density main penetrator body engages against and extends axially rearward away from the rear face of the rear body. A casing sleeve engages snugly around the core elements and has a front end generally at the front element and a rear end secured to the main penetrator body. An aerodynamic tip is secured to and extends axially forward from the front end of the sleeve.

Such an inertial-action shell is extremely effective in penetrating laminated or compartment armor. Nonetheless it is not as good against very heavy armor or laminated armor having a particularly heavy outer layer, that is against such armor the above-described stack-core shell does not penetrate as far as a one-piece armor-piercing bullet.

Thus different type of shells must be used against different targets, or a tradeoff must be made between effectiveness against the one type of armor versus against the other armor type.

OBJECTS OF THE INVENTION

It is therefore an object of the present invention to provide an improved undercaliber penetrator shell.

Another object is the provision of such an undercaliber penetrator shell which overcomes the above-given disadvantages.

Yet another object is to provide a penetrator shell of the stack-core type which is effective against very heavy armor or laminated armor with a very heavy outer layer.

SUMMARY OF THE INVENTION

These objects are attained according to the instant invention in a penetrator shell comprising similar front, intermediate, and rear core elements each having an at least partially forwardly convex front face and an at least partially complementarily rearwardly concave rear face and lying in a stack extending along an axis with the front faces of the intermediate and rear elements engaging in the rear faces of the respective front and intermediate elements. A high-density main penetrator body engages against and extends axially rearward away from the rear face of the rear body. A high-density casing sleeve engaged snugly around the core elements has a front end generally at the front element and a rear end secured to the main penetrator body. An aerodynamic tip is secured to and extends axially forward from the front end of the sleeve. This tip bears axially rearward on the front core element and presses same and the other elements axially rearward against one another and the main penetrator body.

The tip according to this invention is removable and the core elements are separable from the main body when the tip is removed. This allows the arrangement to be specifically tailored to any particular type of armor relatively easily.

The tip according to this invention is of steel. The elements form radially outwardly open annular grooves at the faces. This causes the shell to break apart at these grooves. In addition the elements have generally cylindrical outer surfaces centered on the axis and of generally the same diameter. The sleeve itself is generally cylindrical and of substantially uniform wall thickness. It is force fitted to the main body. The sleeve and body of this invention have generally cylindrical outer surfaces centered on the axis and of substantially the same diameter.

In accordance with another feature of this invention the front end of the sleeve is threaded and the tip is complementarily threaded and screwed onto the front sleeve end. In addition the tip is axially rearwardly flared and the front element is complementarily forwardly tapered to fit in tight annular surface contact with the tip. This arrangement allows the tip to be screwed down to tightly lock the system together.

According to another feature of the present invention at least the rear and intermediate elements are annular and the main penetrator body is formed with a centering stem extending axially forward through the rear and intermediate elements. The front element is formed at its rear face with a rearwardly open recess into which the centering stem engages. This stem is forwardly tapered and the rear and intermediate elements with the recess of the front element form a complementarily forwardly tapered passage in which the stem is snugly received. The stem is integrally formed of high-density material with the main penetrator body.

All the elements of the shell according to this invention are centered on the axis. The faces are surfaces of revolution centered on the axis for automatic self-centering. In addition the faces are of increasing apex angle from front to rear, that is they are more pointed toward the rear. Furthermore the front end of the main body has a front face centered on the axis and complementarily fitting in the rear face of the rear core element.

DESCRIPTION OF THE DRAWING

The above and other features and advantages will become more readily apparent from the following, reference being made to the accompanying drawing in which.

SPECIFIC DESCRIPTION

Figure 1:
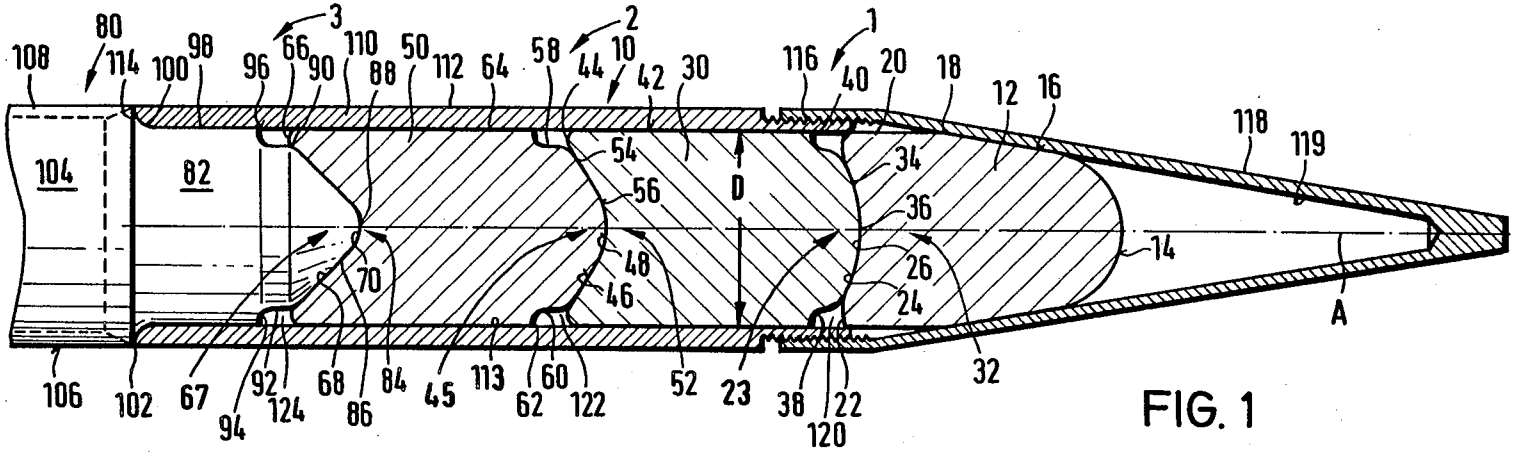
FIG. 1 is an axial section through a shell according to the invention.

As seen in FIG. 1 a penetrator according to this invention basically has a front part 10 formed by front, intermediate, and rear core elements 12, 30, and 50 surrounded by a casing sleeve 110, a rear part formed by a main high-density penetrator body 80, and an aerodynamic tip 118, all centered on a longitudinal axis A.

The tip 118 is rearwardly cupped and has a frustoconical and rearwardly flared inner surface 119 centered on the axis A and going over at its rear edge to an internally threaded cylindrical portion 116. The front core element 12 has a part-spherical front surface 14 centered on the axis A and merging with a frustoconical surface 16 that flatly engages the inner surface 119 and that goes over at a rear edge 18 into a cylindrical side surface 20 of diameter D and centered in the axis A. This element 12 further has a rear face 23 formed with a rounded outer rim 22, a part-spherical or flat frustoconical outer region 24 centered on the axis A, and a central part-spherical region 26 also centered on the axis A.

The intermediate element 30 has a front face 32 formed with a part-spherical central region 36 and a part-spherical or flat frustoconical outer region 34 complementary to the regions 24 and 26, respectively. The outer region 24 curves out at 38 to join a cylindrical outer side surface 42 of the element 30 at a circular edge 40. The elements 12 and 30 together form a radially outwardly open circumferential groove 120 at their faces 23 and 32. The element 30 has a rear face 45 having a rounded outer rim 44, a frustoconical intermediate portion 46, and a part-spherical central region 48 all centered on the axis A. The apex angle of the rear face 45 is substantially greater than that of the rear face 23 and front face 32.

The rear element 50 has a front face 52 with an intermediate region 54 and central region 56 complementary to the regions 46 and 48 and extends back to a short cylindrical surface 58 that rounds out at 60 to the circular leading edge 62 of a cylindrical side surface 64 of the same diameter D as the surfaces 42 and 20. The element 50 has a rear face 67 having a rounded outer rim 66, a frustoconical intermediate portion 68, and a part-spherical central region 70 all centered on the axis A. The apex angle of the rear face 67 is substantially greater than that of the rear face 45 and front face 52. In addition the elements 30 and 50 together form a radially outwardly open circumferential groove 122 at their faces 45 and 52.

When the projectile described above flatly strikes an armored target, the tip 118 will immediately disintegrate and the front element 14 will bite into the armor effectively. The front element will then be deflected laterally until the rim 22 comes against the edge 38, whereupon the entire next core part 30 will be tipped in the same manner. The element 50 will similarly be tipped, and this will be transmitted to the main body 80, thereby pointing the projectile into the armor for excellent penetration.

The main penetrator body 80 has a front end projection 82 formed with a front face 84 having an intermediate region 86 and central region 88 complementary to the regions 86 and 88. This face 84 joins at an edge 90 a short cylindrical surface 92 that rounds out at 94 to the circular leading edge 96 of a cylindrical side surface 98 of the same diameter D as the surfaces 64, 42, and 20. This side surface 90 in turn rounds out at 100 to the cylindrical front edge 102 of a cylindrical side surface 106 of a screwthread 108 of a main part 104 of the penetrator body 80. In addition the element 50 and front end part 82 together form a radially outwardly open circumferential groove 124 at their faces 67 and 84.

The sleeve 110 has a rear end surface 114 complementary to the rounded region 100 and has a cylindrical outer surface 112 of the same outer diameter as the surface 106. The inner surface 113 of the sleeve 110 is of the diameter D so it snugly engages the side surfaces 98, 42, and 64 and centers the bodies 30 and 50 on the axis A. As mentioned above the tip 118 is screwthreaded onto the front end 116 of the sleeve 110 so that when screwed down it forces the front element 12 axially back against the element 30, thereby forcing same axially back against the element 50, and in turn forcing same back against the front end 82. Thus this sleeve 110 serves to lock the entire stack 12, 30, and 50 axially snugly together.

The shell according to this invention has three fracture zones or planes 1, 2, and 3 at the interfaces between the elements 12, 30, 50, and the front end 82, level with the respective grooves 120, 122, and 124. The core elements 12, 30, and 50, the front part 82, the main body 80, and the sleeve 110 are formed of a high-density material, such as a sintered tungsten alloy. The tip 118 is of steel.

Figure 2:
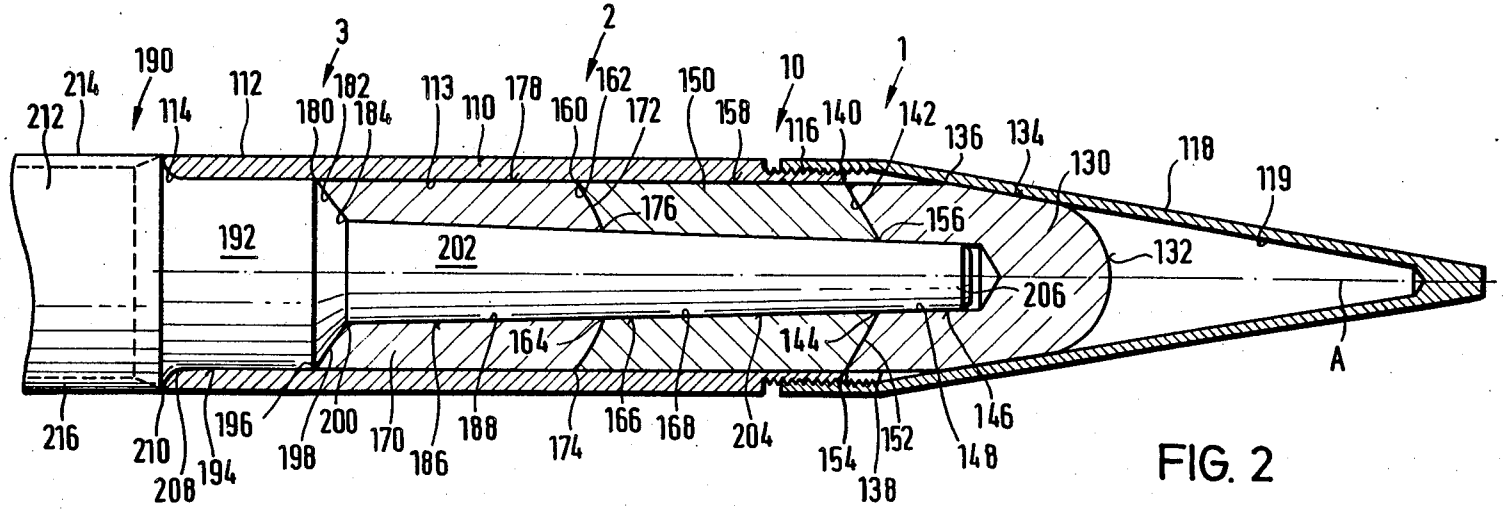
FIG. 2 is a section like FIG. 1 through another shell in accordance with this invention.

In the arrangement of FIG. 2 structure identical to that of FIG. 1 is identified with the same references. This identical structure is principally the tip 118 and sleeve 110.

Here the penetrator has a front part 10 formed by front, intermediate, and rear core elements 130, 150, and 180 surrounded by the casing sleeve 110, a rear part formed by a main high-density penetrator body 190, and the aerodynamic tip 118, all centered on the axis A.

The front core element 130 has a part-spherical front surface 132 centered on the axis A and merging with a frustoconical surface 134 that flatly engages the inner surface 119 and that goes over at edge 136 to a cylindrical side surface 138. This element 130 further has a frustoconical rear face 142 with circular outer and inner edges 140 and 144 and is centrally formed with an axially centered recess 146 having a frustoconical and rearwardly flared inner surface 148.

The intermediate element 150 has a frustoconical front face 152 complementary to the face 142 and having outer and inner edges 154 and 156, respectively. This element 150 is formed with an axially centered and throughgoing bore 166 having a frustoconical inner surface 168 forming a continuation of the surface 148 and has a cylindrical outer surface 158 extending from the edge 154 to the outer edge 160 of another frustoconical rear surface 162 identical to the surface 142 and having an inner edge 164 at the passage or bore 166.

The rear element 180 has a front face 172 extending between an outer edge 174 and an inner edge 176 and lying flatly on the surface 162. A cylindrical side surface 178 forming an extension of the surfaces 158 and 138 extends back from the edge 174 to the outer edge of a frustoconical rear surface 182 having an inner edge 184 at another bore or passage 186 having an inner wall 188 forming an extension of the walls 148 and 168.

The main penetrator body 190 here has a front-end extension 192 with a cylindrical outer surface 194 rounded at 208 to an outer edge 210 bounding the front end of its cylindrical outer surface 214 formed on the main part 212 of this body 190 at the screwthread 216. The cylindrical surface 194, to which the rear end of the sleeve 110 is a tight fit, extends forward to an outer edge 196 of a frustoconical surface 198 fitting flatly with the surface 182 and terminating at an inner edge 200 which is the outer edge for a forwardly extending and axially centered stem 202 having a frustoconical outer surface 204 fitting snugly against the surfaces 188, 168, and 148 and having an extreme front end 206 fitted in the recess 146.

With this arrangement, as in FIG. 1, the tip 118 axially presses the core elements together so they cannot move relative to one another. The stem 202 centers them.

When such a projectile flatly strikes a target it will be twisted like the FIG. 1 pojectile, but with fracturing of the stem 202 at the regions 1, 2, and 3 sequentially. As the stem 202 is thicker toward its rear end, the fracturing force will increase, thereby effectively turning the main body 190 into the target. Such action increases the size of the hole made by the projectile, thereby facilitating entry of the following mass, a feature that is particularly advantageous with modern ceramic- or glass-based armors.

We claim:

1. An improved subcaliber fin-stabilized penetrator projectile which has a ballistic hood coaxially mounted on the front end thereof and a plurality of pre-penetrator cores consisting essentially of tungsten alloy and mounted one behind the other in an axial direction behind said ballistic hood, and a main penetrator consisting essentially of tungsten alloy, a cylindrical casing having a smooth external surface being operatively detachably connected to said ballistic hood, said plurality of pre-penetrator cores being operatively mounted partially in said cylindrical casing and partially in said ballistic hood, the improvement comprising in combination (a) said cylindrical casing axially extends rearwardly from the ballistic hood to a forward region of the main penetrator;

(b) the outer diameter of the main penetrator corresponds to the outer diameter of the cylindrical casing so that the projectile presents a smooth outer cylindrical surface over its entire axial length with the exception of the ballistic hood;

(c) each one of said plurality pre-penetrator cores has the same external diameter and said plurality of pre-penetrator cores are of complementary shape so that the front surface of the rearmost core abuts against the rear mating surface of the next forwardly positioned pre-penetrator core and so on;

(d) the mutually contacting front and rear surfaces of the respective pre-penetrator cores are matingly shaped;

(e) the pre-penetrator cores are detachably joined to each other and the casing by means of detachably mounting said ballistic hood on said casing;

(f) the confronting surfaces of the adjoining cores are complementarily axially convexly and concavely shaped;

(g) the degree of convexity and concavity increases from front to rear with respect to the longitudinal axis of the projectile;

(h) each pair of confronting surfaces of adjoining cores and said casing jointly define an annular space in said casing;

(i) the rear end surface of each pre-penetrator core and the front surface of the corresponding core being rounded off and matingly shaped so that when a pre-penetrator core pivots with respect to the next rearwardly adjoining core the latter core maintains its direction of movement;

(j) the ballistic hood is made of steel and the casing is made of tungsten alloy; and (k) said casing and ballistic hood maintain the pre-penetrator cores in a play-free operative ready-to-fire condition.

2. The improvement in a subcaliber fin-stabilized penetrator projectile as set forth in claim 1, wherein said main penetrator has an axially rearwardly extending main portion and a forwardly extending coupling portion, said casing snugly fitting on said forwardly extending portion.

* * * * *